US006061855A

United States Patent [19]

Flick

[11] Patent Number: 6,061,855

[45] Date of Patent: May 16, 2000

[54] CPR DUMP MANIFOLD

[75] Inventor: Roland E. Flick, Elma, N.Y.

[73] Assignee: Gaymar Industries, Inc., Orchard Park, N.Y.

[21] Appl. No.: 09/070,543

[22] Filed: Apr. 30, 1998

Related U.S. Application Data

[63] Continuation-in-part of application No. 08/748,209, Nov. 12, 1996, Pat. No. 5,794,289.

[51] Int. Cl.[7] ..... A47C 27/10

[52] U.S. Cl. ..... 5/713; 5/706; 5/710; 5/655.3

[58] Field of Search ..... 5/706, 710, 713, 5/714, 644, 655.3, 654, 914; 137/118.01, 98, 861; 251/223, 226, 231

[56] References Cited

U.S. PATENT DOCUMENTS

| | | | |
|---|---|---|---|
| 5,152,021 | 10/1992 | Vrzalik | 5/455 |
| 5,216,768 | 6/1993 | Bodine et al. | 5/453 |
| 5,487,196 | 1/1996 | Wilkinson et al. | 5/914 X |
| 5,542,136 | 8/1996 | Tappel | 5/710 |
| 5,553,339 | 9/1996 | Thomas | 5/710 |
| 5,586,346 | 12/1996 | Stacy et al. | 5/710 |
| 5,634,225 | 6/1997 | Miller, Sr. et al. | 5/710 |
| 5,699,570 | 12/1997 | Wilkinson et al. | 5/713 |

OTHER PUBLICATIONS

1998 Rectus Corporation Brochure, p. 29.

*Primary Examiner*—Michael F. Trettel
*Assistant Examiner*—Fredrick Conley
*Attorney, Agent, or Firm*—Hodgson, Russ, Andrews, Woods & Goodyear, LLP

[57] ABSTRACT

The present invention is a patient support system. The system includes a mattress unit, an inflatable bladder, a manifold plate and a quick release plate. The mattress unit contains the inflatable bladder. The manifold plate allows air to enter into and be released from the bladder. The manifold plate has a set of female receptacles open to the exterior surface of the mattress unit. The quick release plate has a set of male connectors that correspond to the female receptacles. Each male connector has a slidable variance, permitting it to be removably received from the corresponding female receptacle. Thus, when any pulling force is applied to the quick release plate, the quick release plate disengages from the manifold plate resulting in the bladder deflating within a predetermined time frame.

17 Claims, 12 Drawing Sheets

FIG. 2
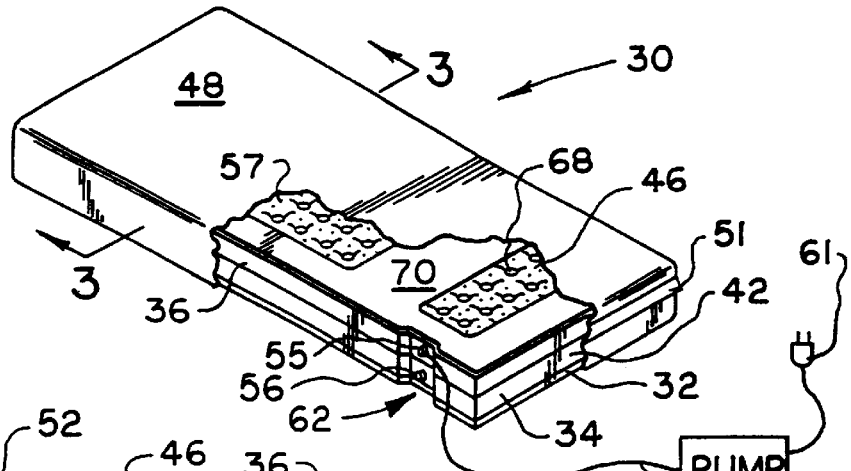
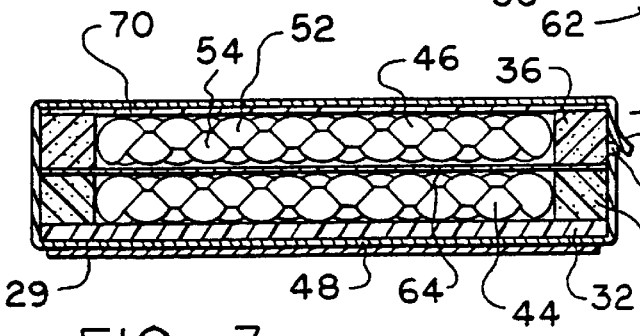
FIG. 3
FIG. 6
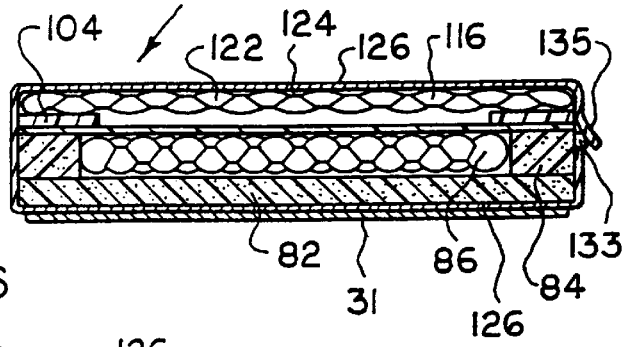
FIG. 5
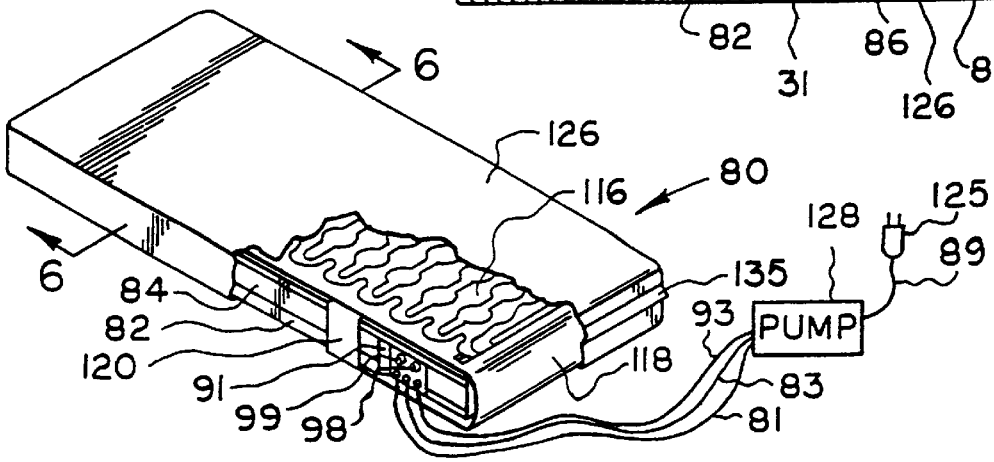

FIG. 8
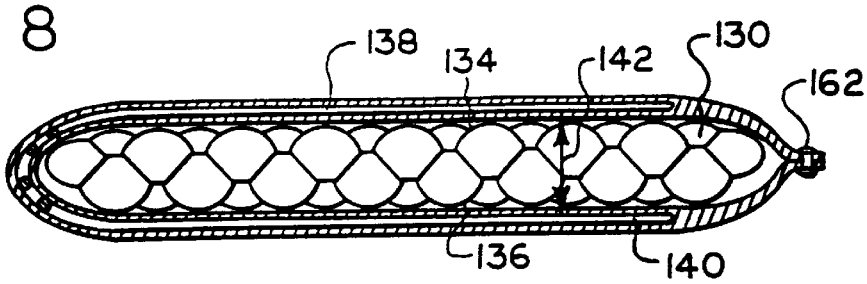
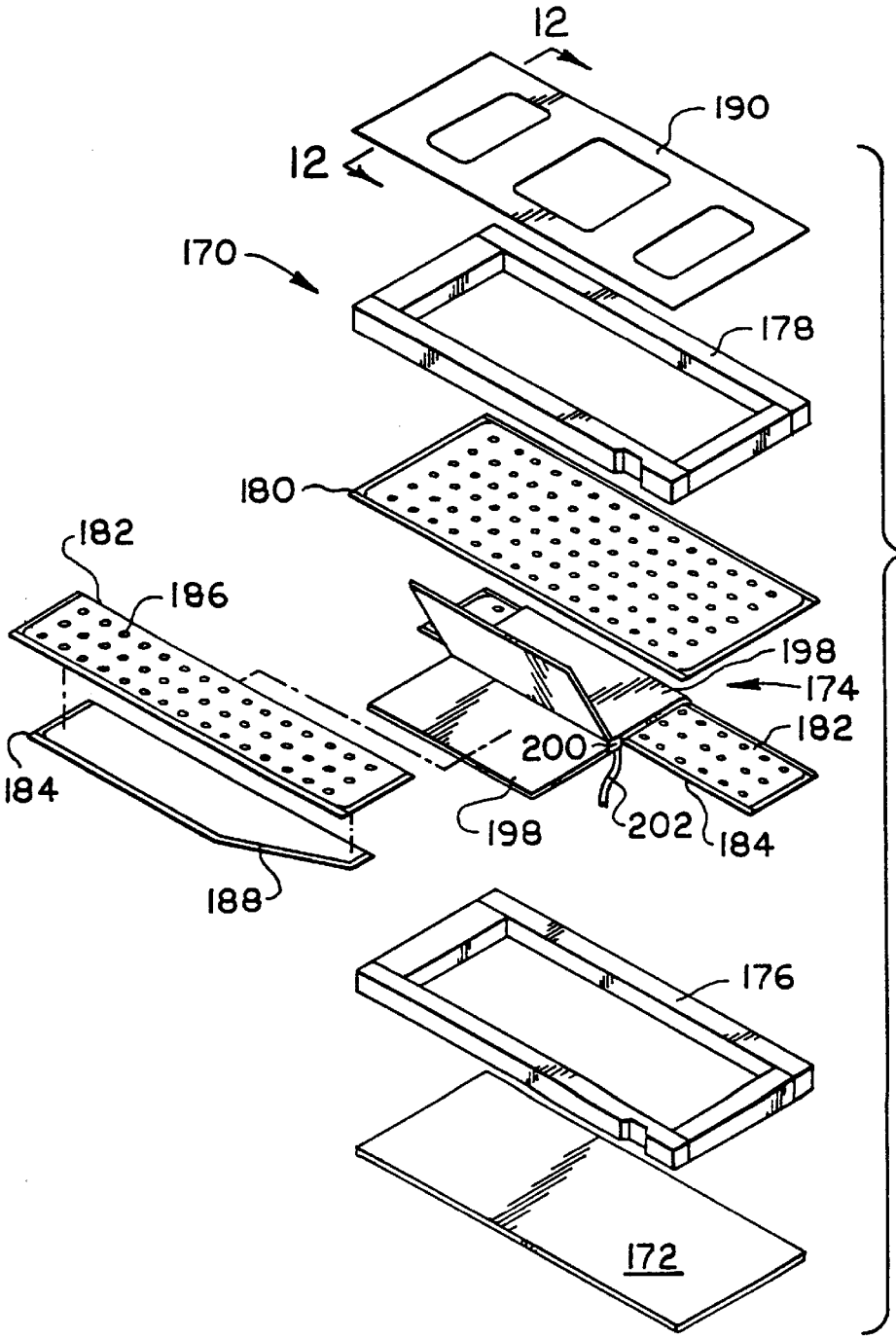
FIG. 11

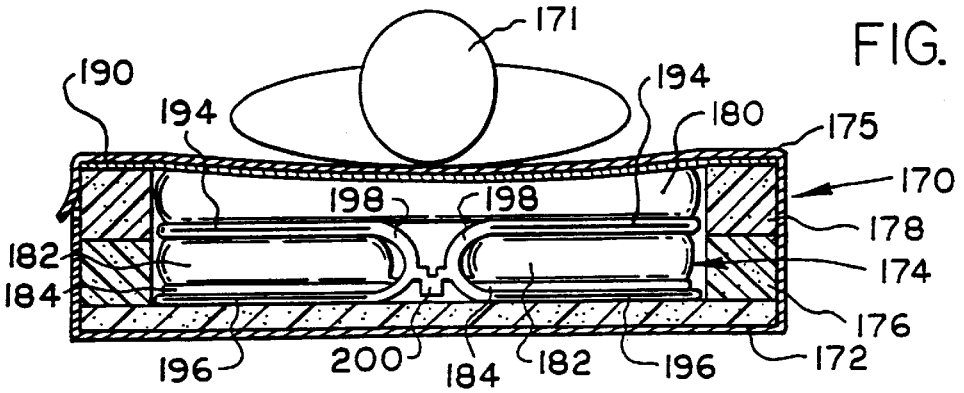
FIG. 12
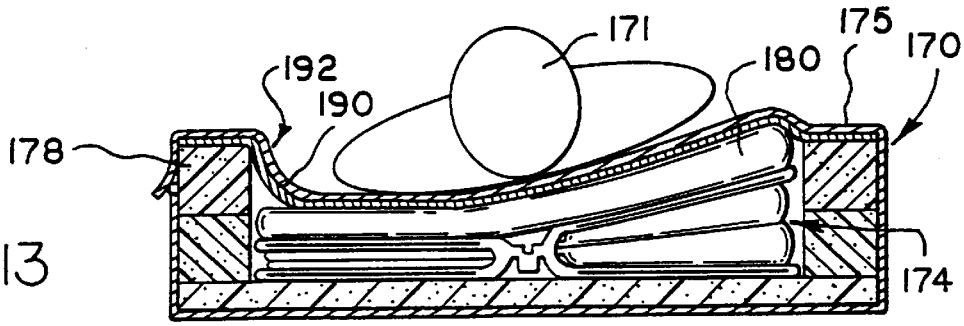
FIG. 13
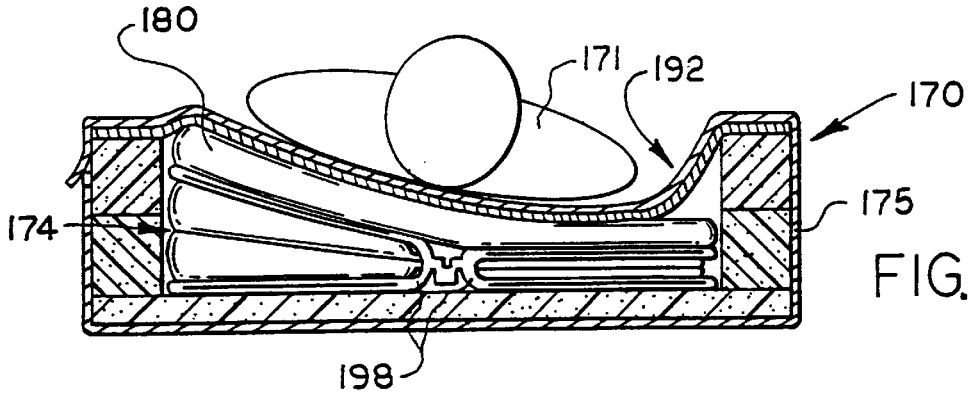
FIG. 14
FIG. 24
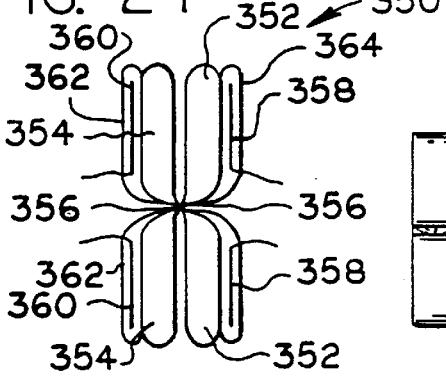
FIG. 23
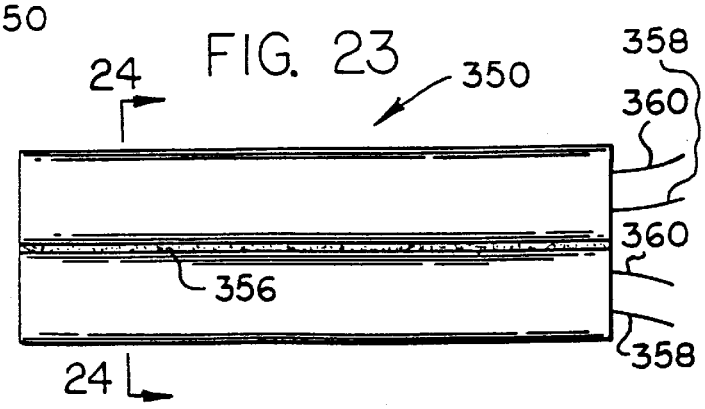

FIG. 15
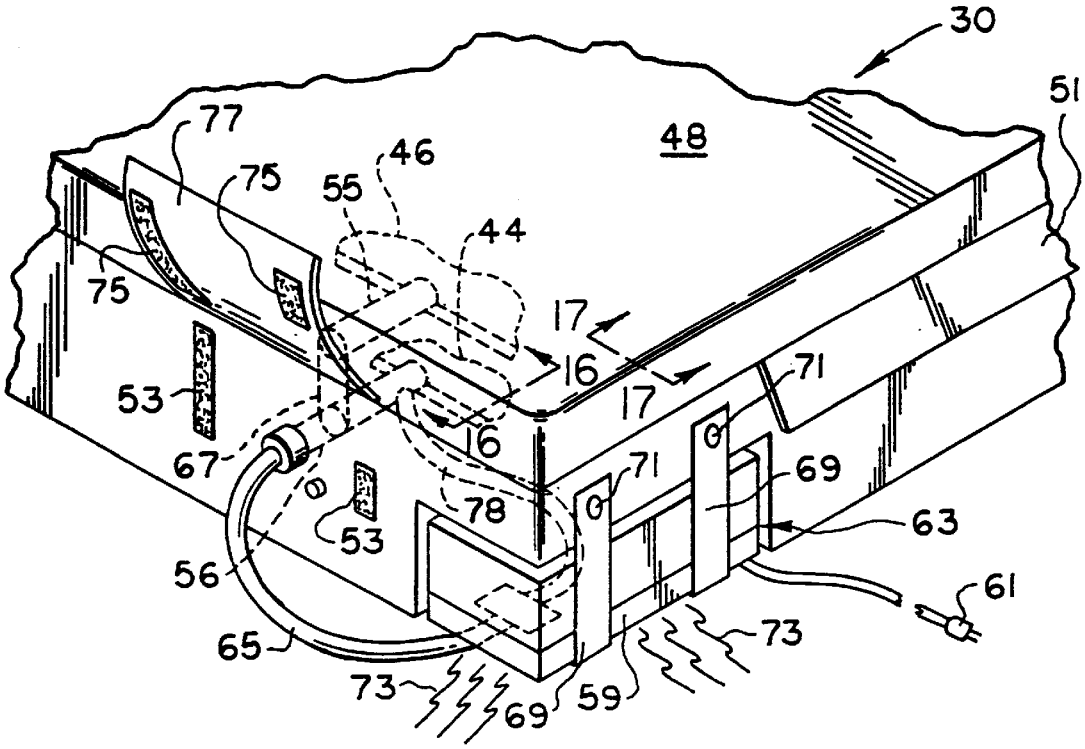
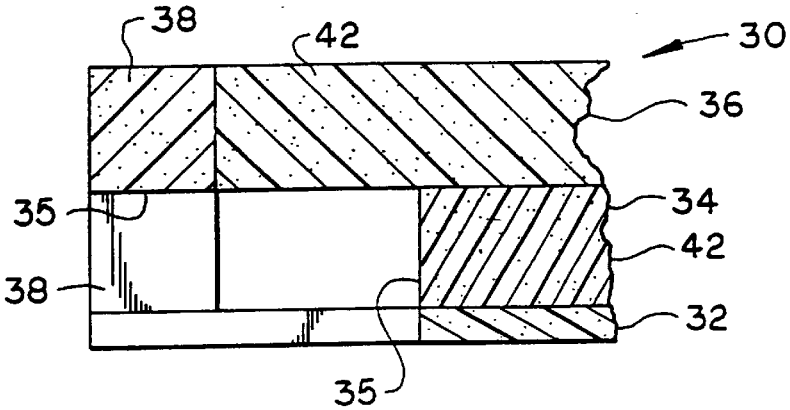
FIG. 16
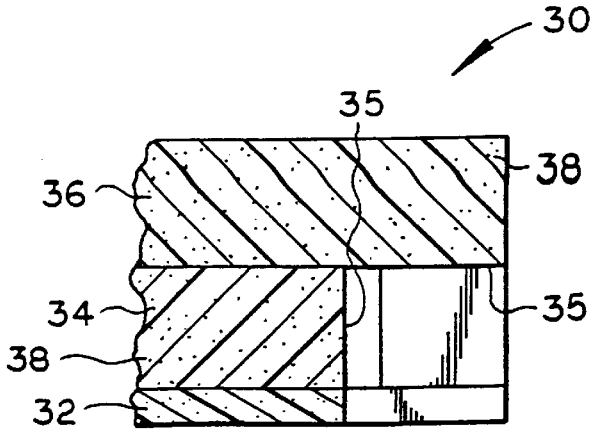
FIG. 17

FIG. 25
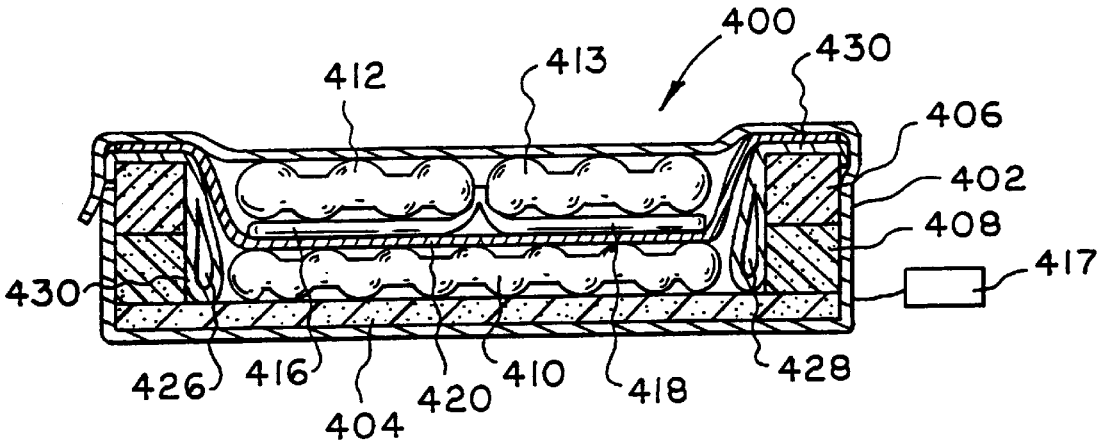
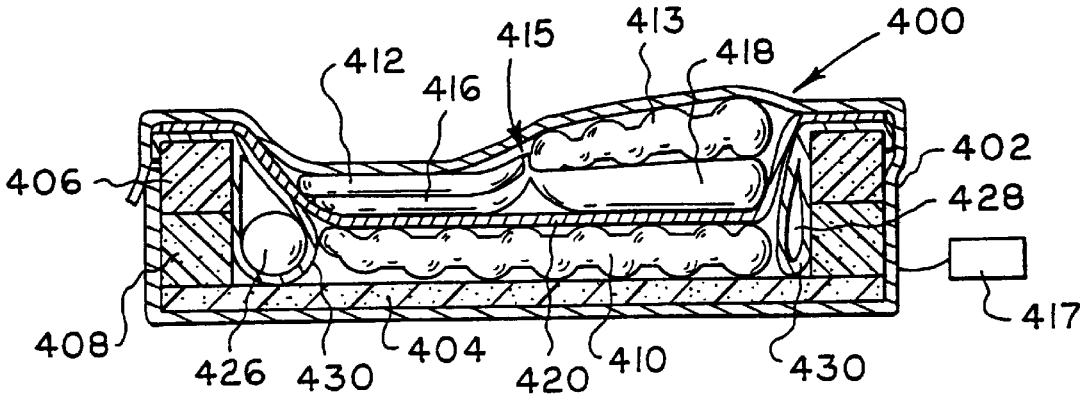
FIG. 26
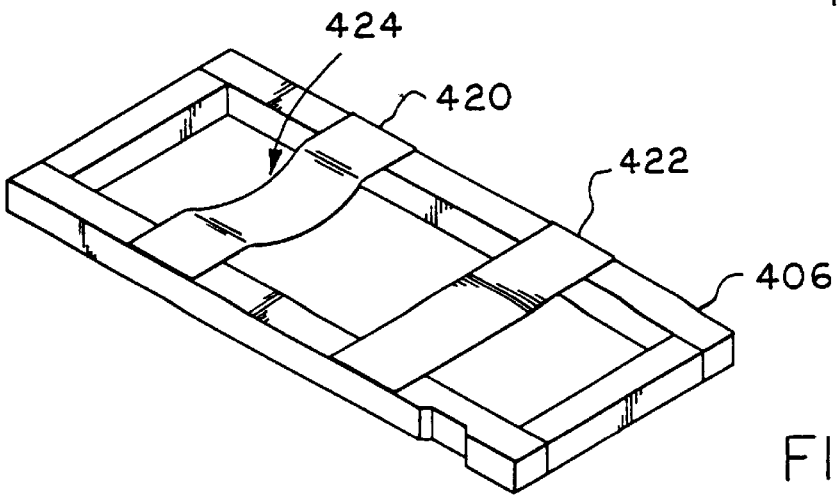
FIG. 27

CPR DUMP MANIFOLD

This application is a continuation-in-part of Application Ser. No. 08/748,209 filed Nov. 12, 1996, now U.S. Pat. No. 5,794,289.

FIELD OF THE INVENTION

The present invention relates to a mattress system having an inflatable bladder and a control unit for controlling a pressure within the bladder and, more particularly, to such a mattress system that can deflate within a prescribed time frame.

BACKGROUND OF THE INVENTION

Decubitus ulcers, commonly known as bedsores, typically develop when a patient spends a relatively long period of time recuperating in bed with a minimal amount of movement. Various different types of beds and mattresses have been designed to avoid the development of decubitus ulcers and/or to treat decubitus ulcers which have already developed. One known type uses a mattress containing an inflatable bladder arrangement with a number of separate zones, and a control unit that separately controls the pressure in each zone. Such a mattress is described in U.S. Pat. No. 5,542,136. While mattresses of this type have been generally adequate for their intended purposes, they have not been satisfactory in all respects.

At least where there are a plurality of zones, the mattress unit is often an integral part of an entire bed. Since the mattress is the entire bed and has various bladder means, the mattress unit deflates slowly. In some instances, the mattress unit must deflate in seconds, not minutes. Such rapid deflation is necessary when the patient requires emergency care, such as, cardiopulmonary resuscitation (CPR). This rapid deflation is commonly called CPR drop.

The conventional CPR drop, as described in U.S. Pat. No. 5,542,136, entails pushing a CPR button. That CPR button causes the control unit to deflate the bladders. That control unit opens all the valves and reverses the direction of the blower so the blower sucks air out of the bladders. The "sucked air" enters a manifold. That manifold directs the "sucked air" into a conduit that expels the "sucked air."

Obviously, that CPR drop system, of U.S. Pat. No. 5,542,136, has numerous mechanical operations that must operate properly to deflate the numerous bladders. If one of those mechanical operations (the electrical connection between the CPR button and the other electrical instruments, i.e., the blower and valves, the blower must timely switch its direction and speed, the valves must switch, the manifold must be capable of directing all the "sucked air" into the single conduit, and the single conduit must be large enough to direct the "sucked air" out of the manifold) does not properly or timely operate then the CPR drop system essentially malfunctions. Such malfunctions are extremely deleterious to the patient and should be avoided.

It is therefore an object of the present invention to provide an inflatable mattress system that has a CPR drop system that avoids any possible malfunctions. Thereby, insuring the safety of the patient.

A further object of the invention is to provide a mattress system wherein a person with limited training can perform the CPR drop safely and effectively in a prescribed time frame.

SUMMARY OF THE INVENTION

The objects and purposes of the invention, including those set forth above, are met according to the present invention.

The present invention is a patient support system. The system includes a mattress unit, inflatable bladder means, an air control unit, a manifold plate and a quick release plate. The mattress unit has therein the inflatable bladder means, has operational and collapsed states in which the bladder means is respectively inflated and deflated, has an exterior surface which includes an upwardly facing top portion in the operational state, and has at one end a foot section. In the foot section, the mattress unit also has a portion of the bladder means and has means defining in the foot section below the portion of the bladder means the air control unit within the mattress unit. The air control unit has a manifold plate that interconnects the inflation means to the bladder means. The manifold plate has a set of female receptacles open to the exterior surface of the mattress unit. The quick release plate has a set of male connectors that correspond to the female receptacles. Each male connector has a slidable variance, permitting it to be removably received from the corresponding female receptacle. Thus, when any pulling force from any direction is applied to the quick release plate, the quick release plate disengages from the manifold plate resulting in the bladder means deflating within a predetermined time frame.

BRIEF DESCRIPTION OF THE DRAWINGS

A preferred embodiment of the present invention is described in detail hereinafter with reference to the accompanying drawings, in which:

FIGS. 1–27 are described in U.S. Pat. No. 5,794,289 which is hereby incorporated by reference herein.

DETAILED DESCRIPTION

The elements illustrated in FIGS. 1 to 27 are fully described in U.S. Pat. No. 5,794,289 which is hereby incorporated by reference. U.S. Pat. No. 5,794,289 describes each element of the present invention, except the manifold plate and the quick release plate. These two plates will be detailed in the present invention.

Figure 1:
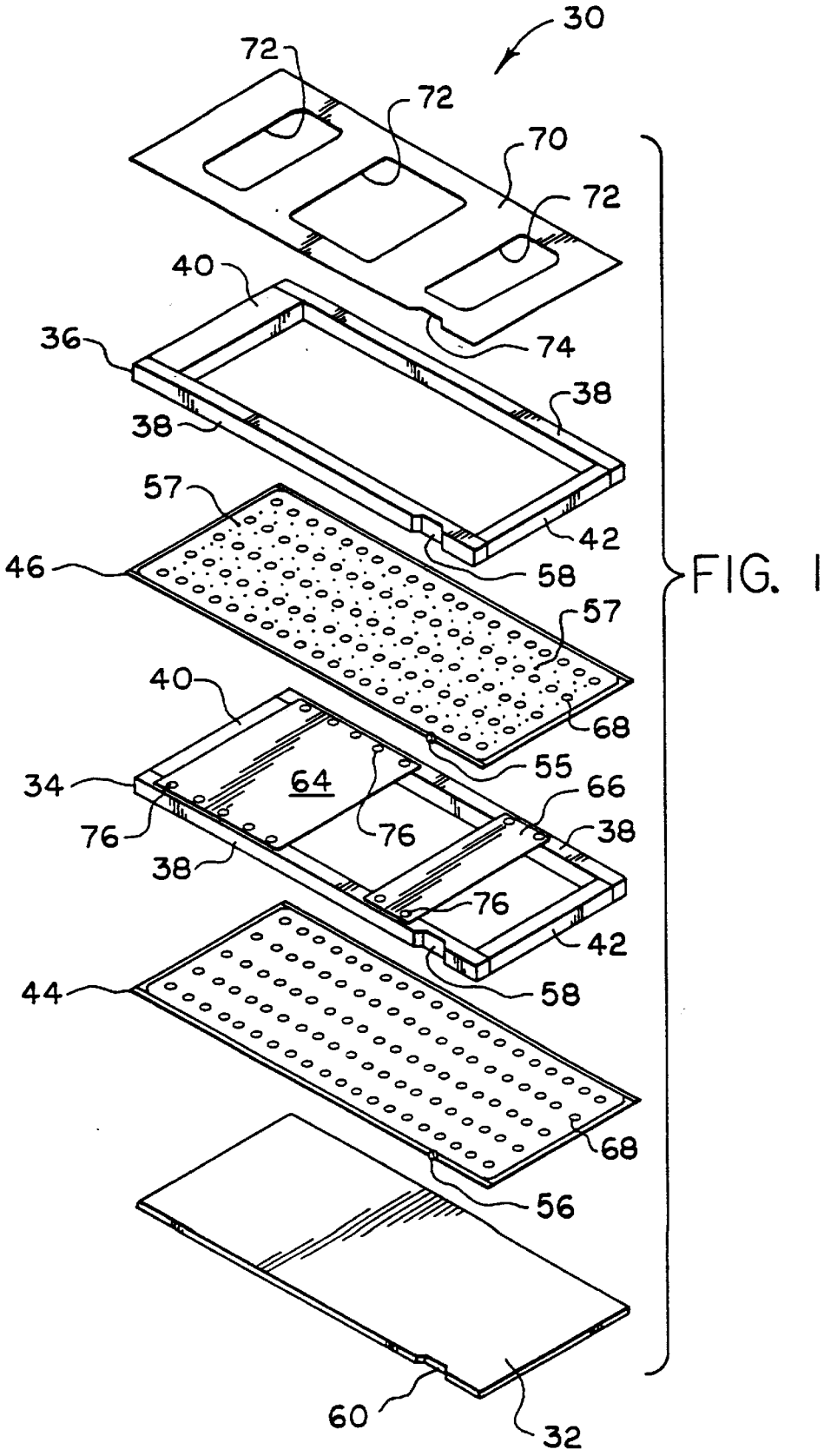
Figure 4:
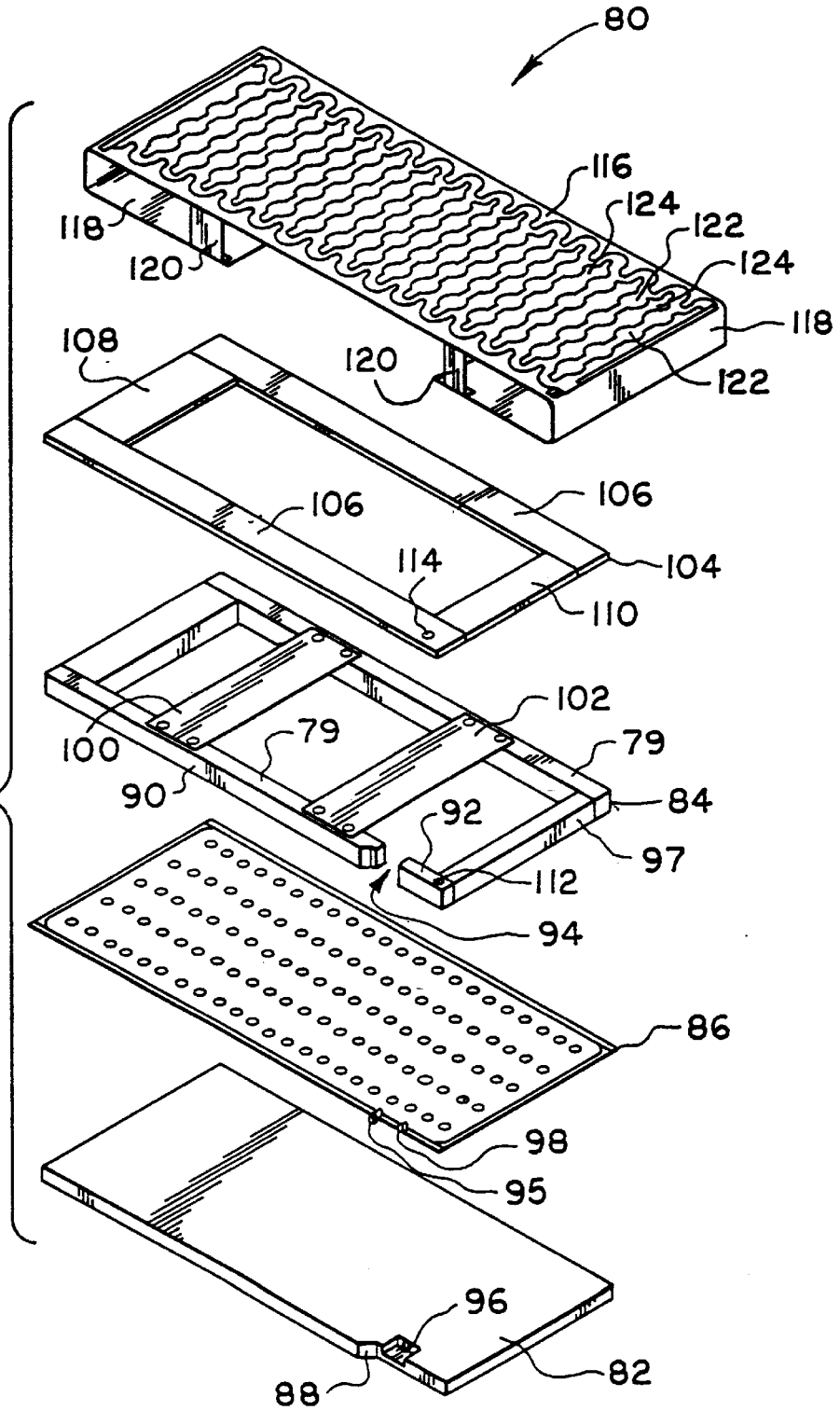
Figure 10:
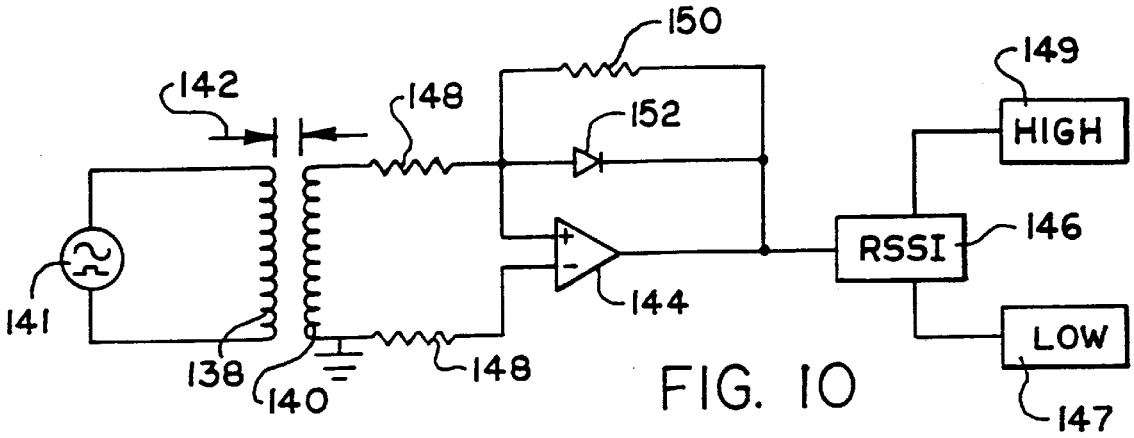
Figure 9:
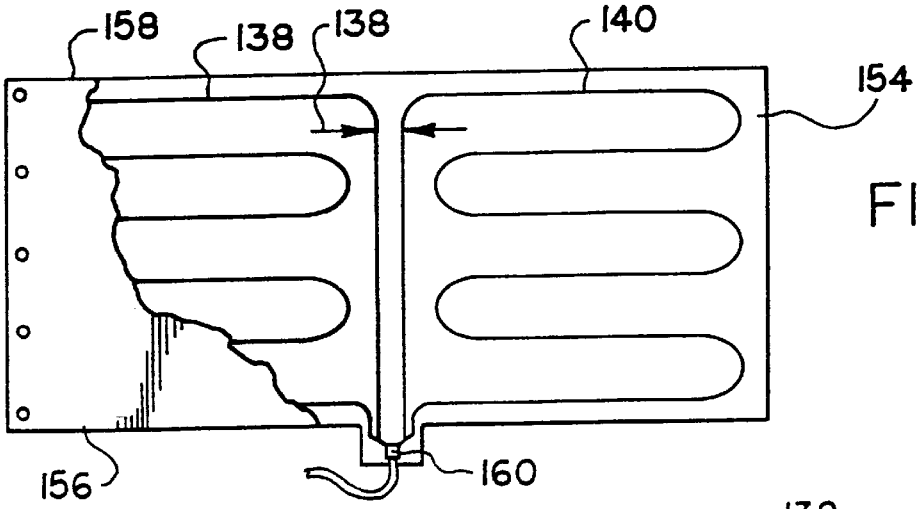
Figure 7:
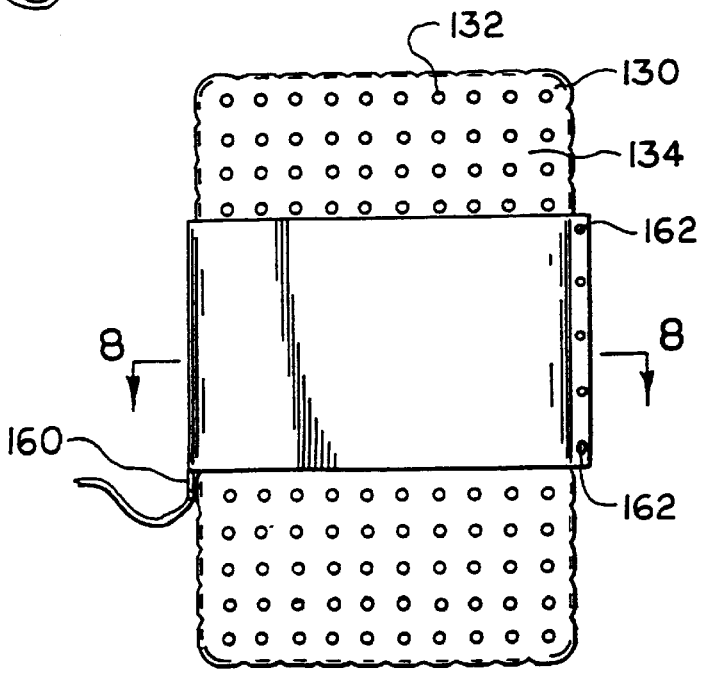
Figure 18:
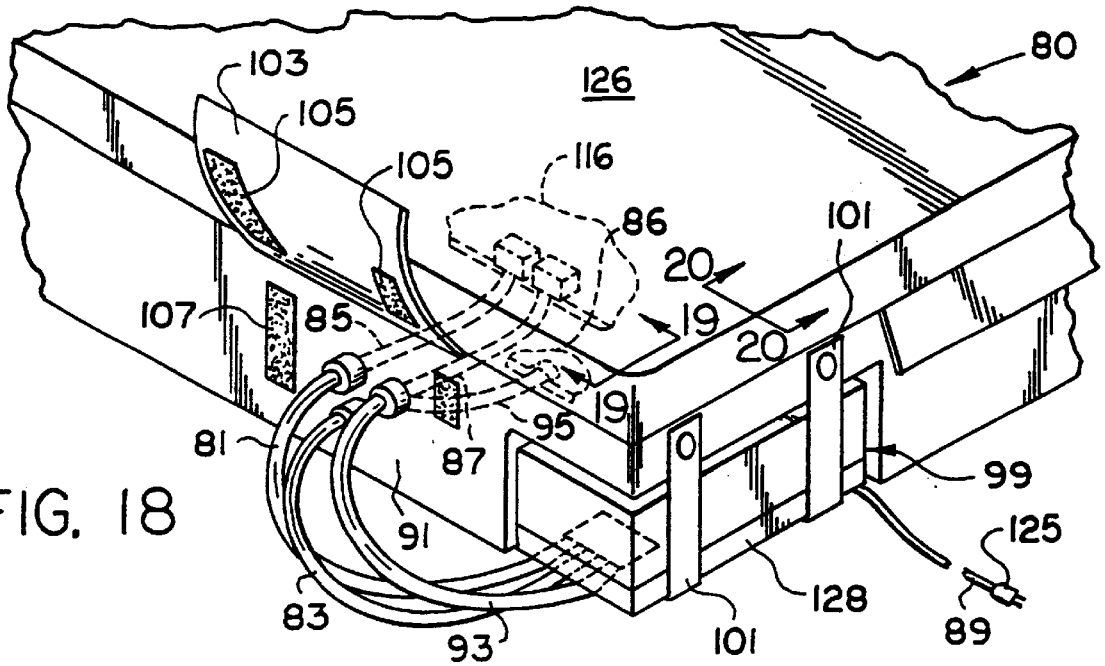
Figure 19:
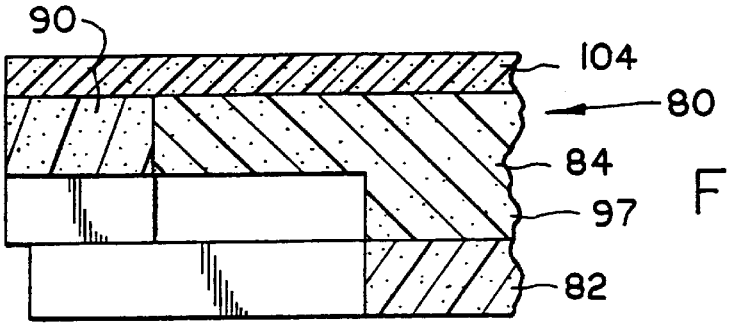
Figure 20:
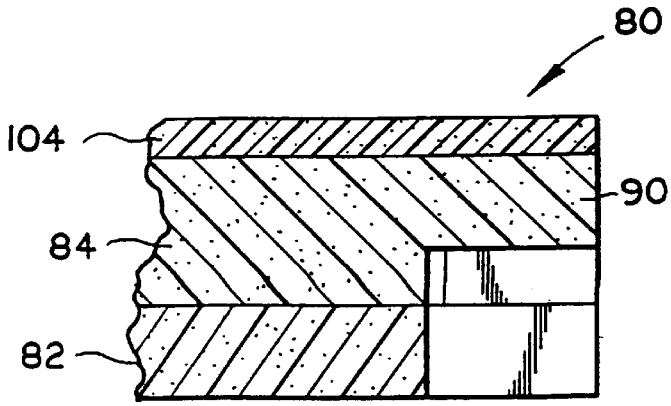
Figure 21:
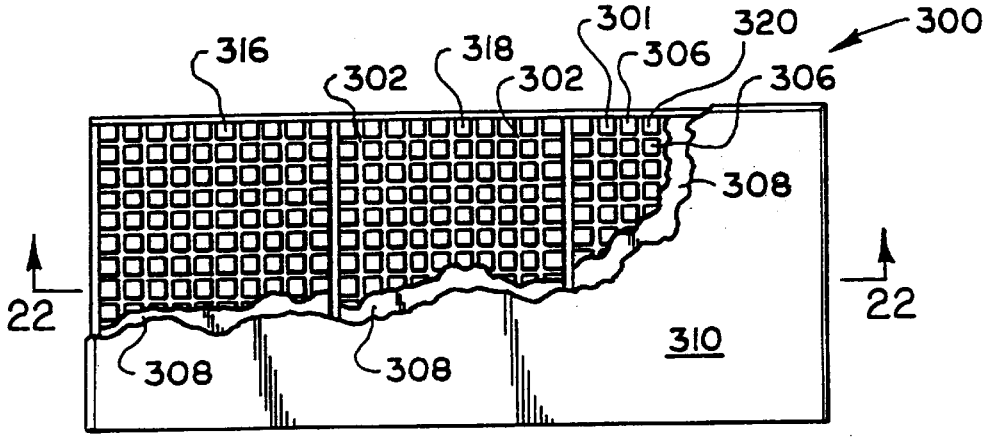
Figure 22:
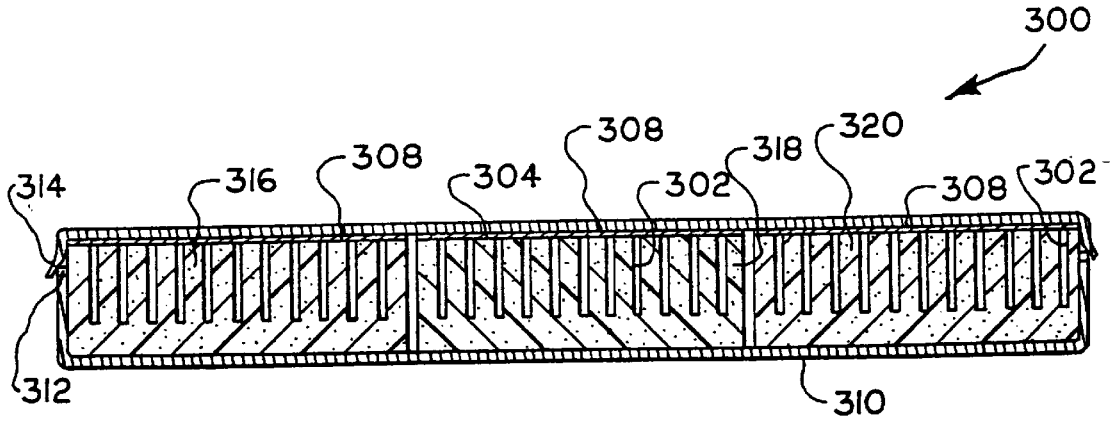
Figure 28:
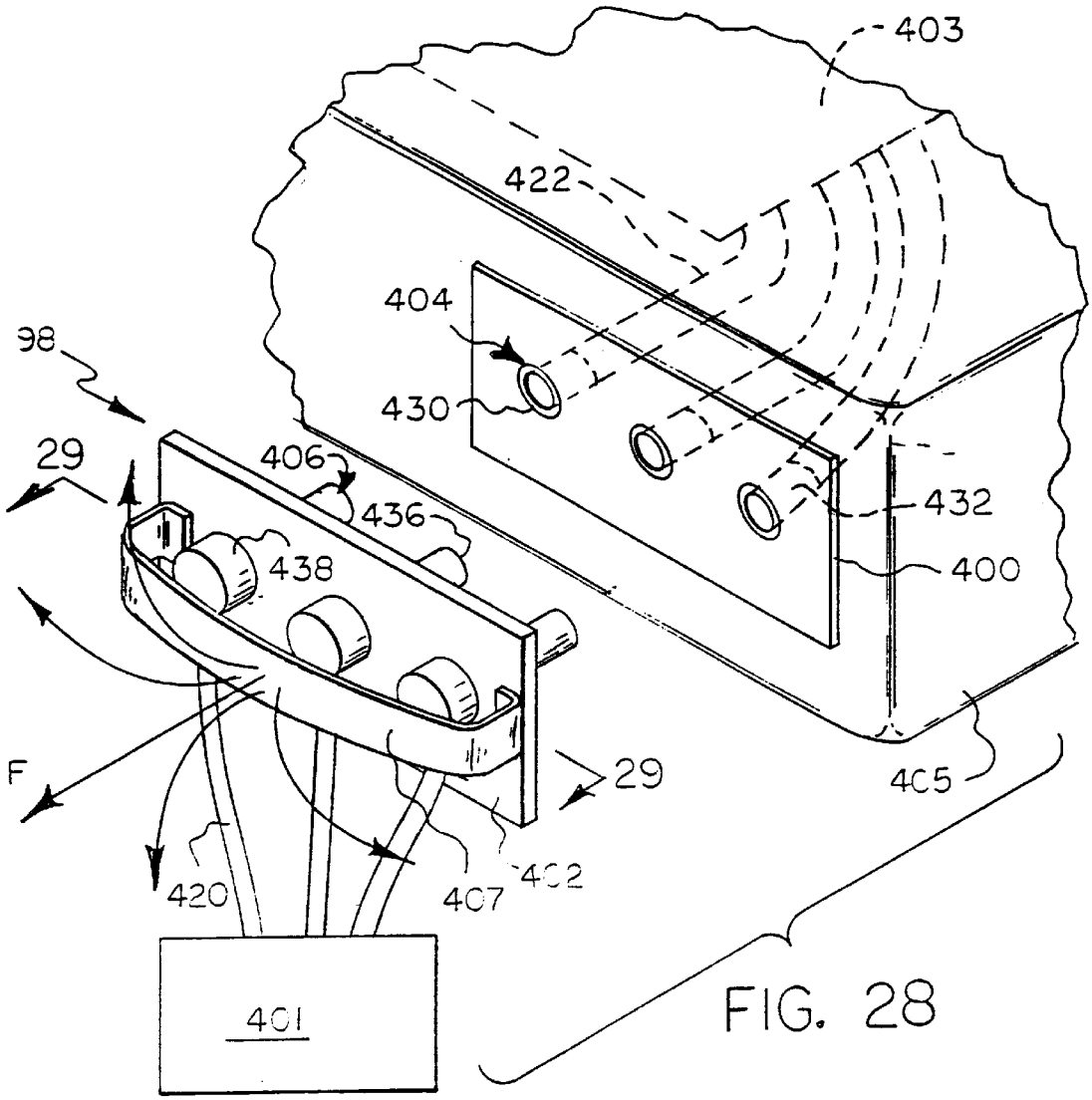
FIG. 28 is an exploded view of the CPR dump valve.

The CPR dump valve 98 allows for quick deflation of the mattress unit in a prescribed time frame. The CPR dump valve 98, as illustrated in FIG. 28, has a manifold plate 400 and a quick release plate 402. The quick release plate 402 directs the pumped air from a pump means 401, and a first conduit means 420 into the manifold plate 400. Manifold plate 400, in return, directs the pumped air into the respective inflatable cushions (or bladders) 403 through a second conduit means 422, as set forth in U.S. Pat. No. 5,794,289.

The manifold plate 400 has a set of female receptacles 404 preferably three or more, attached thereon. These receptacles 404 are conventional female receptacles that are tubular. Each receptacle has a front side 430 and a back side 432. The front side 430 is on the exterior surface of the mattress unit 405 as shown in FIG. 28. The front side 430 receives and directs the pumped air to the back side 432. The back side 432 directs the pumped air into the second conduit means 422. The second conduit means 422 interconnects to the back side 432. Preferably, the second conduit means 422 encases a portion of the back side 432, which is a protrusion that the second conduit means 422 can encase.

Figure 29:
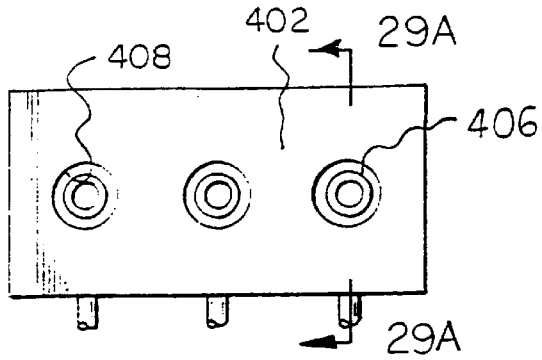
FIG. 29 is a front view of the quick release plate of FIG. 28 taken along line 29—29.
Figure 29A:
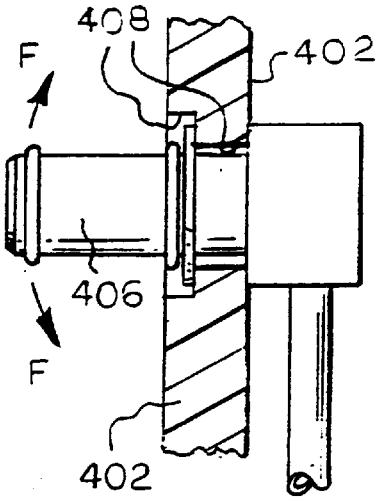
FIG. 29*a* is a cross-sectional view of FIG. 29 taken along the line 29*a*–29*a*.

The quick release plate 402 has a pulling strap 407 and a set of male connectors 406. Each connector 406 mates with a corresponding female receptacle 404. Like the female receptacle 404, the male connectors 406 are conventional male connectors attached to the plate 402. Each connector 406 is tubular and has a front side 436 and a back side 438. The back side 438 receives the first conduit means 420. The front side 436 mates with the front end 430 of the corresponding female receptacle 404. Each male connector 406, on the front side, has a slidable variance 408 as shown in FIG. 29. The slidable variance 408, i.e., 1–5 millimeters in a diametrical clearance and/or linear clearance, allows each male connector to move within a prescribed area on the quick release plate 402 and be pulled on from various angles, as shown in FIG. 29A.

Such slidable variance 408 allows the quick release plate 402 to disengage from the manifold plate 400 when any pulling force (F) is applied to the plate 402 as shown in FIG. 28. In particular, the pulling force (F) applied to plate 402 can be from any direction relative from the manifold plate 400, preferably 30° to 90° relative to the manifold plate 400.

When the quick release plate 402 disengages from the manifold plate 400, the air expels from the bladder means 403 within a prescribed time frame. The prescribed time frame is relative to the weight of the patient. Preferably, the maximum prescribed time frame is fifteen seconds, and more preferably, the maximum prescribed time frame is shorter than fifteen seconds.

Figure 30:
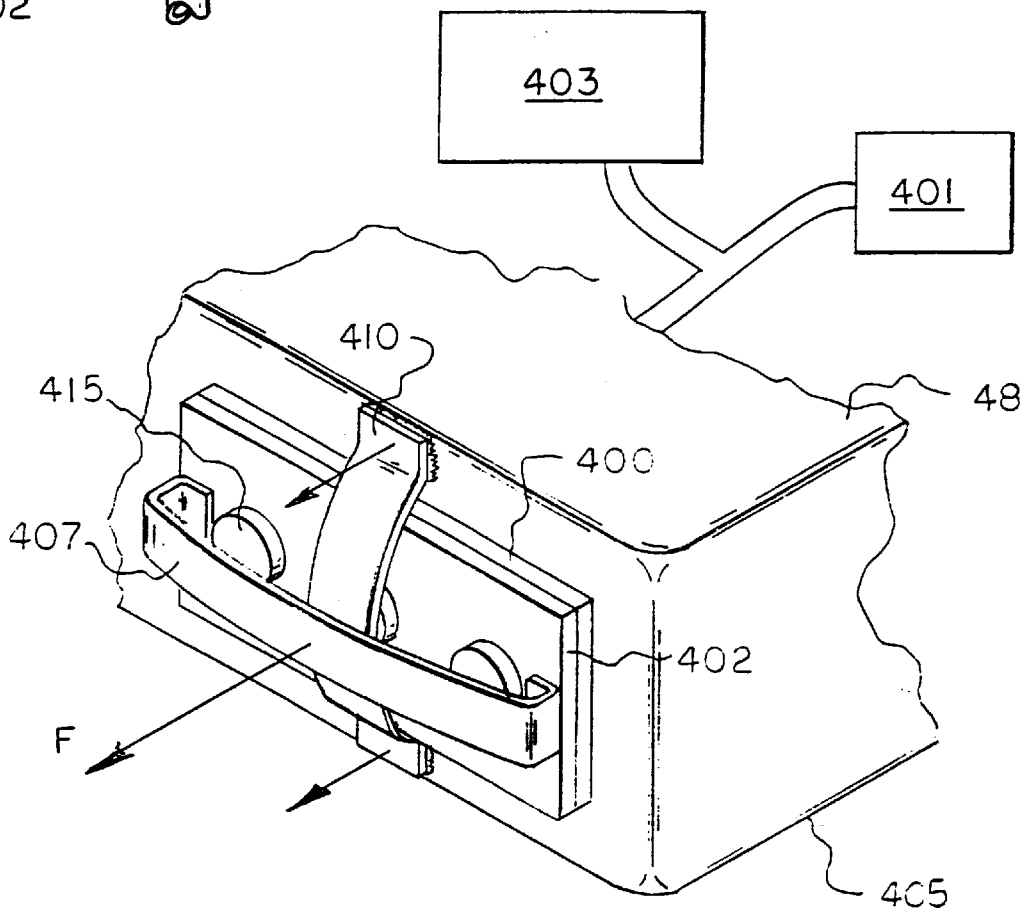
FIG. 30 is an alternative embodiment of FIG. 28.

A releasable security strap 410, as illustrated in FIG. 30, secures the quick release plate 402 to the manifold plate 400. Each end of the strap 410 releasably secures to the cover 48, i.e., by Velcro™. When the quick release plate 402 disengages from the plate 400 the strap 410 disengages from the cover 48 as well. Thereby, the strap 410 does not inhibit the disengagement of the quick release plate 402 from the manifold plate 400.

In other embodiments, the strap 410 can be substituted by magnets, mechanical fasteners or any other conventional known devices.

As shown in FIG. 30, the pump 401 can be within the mattress unit. This alternative pump position requires the quick release plate 402 have a different embodiment. The embodiment is a slight variation in that the plate 402 is the same as above, except it has plugs 415 on the back side 438. Plugs 415 prevent the air from the mattress unit 405 from escaping. When the quick release plate 402, with plugs 415, disengages from the manifold plate 400 the bladders 403 deflate.

In either embodiment or combination of the two embodiments, the operator must recognize a patient requires emergency care, such as cardiopulmonary resuscitation. The operator grabs and pulls the strap 407 thereby disengaging the quick release plate 402 from the manifold plate 400. The bladders 403 deflate and the operator administers cardiopulmonary resuscitation (CPR) on the patient.

Alternatively, the set of female receptacles can be on the quick release plate, and the set of male connectors with the positioning variances can be on the manifold. Similarly, the male connectors can be rigid and female receptacles can have the positioning variance.

Although a particular preferred embodiment of the invention has been illustrated and described in detail for illustrative purposes, it will be recognized that variations or modifications of the disclosed apparatus, including the rearrangement of parts, lie within the scope of the invention defined by the claims.

The embodiments of the invention in which an exclusive property or privilege is claimed are defined as follows:

What is claimed is:

1. A patient support system comprising:

a mattress unit having an interior chamber and an exterior surface;

at least one inflatable bladder is positioned in the interior chamber, the inflatable bladder has operational and collapsed states in which the inflatable bladder is respectively inflated and deflated;

a pump which controls the pressurized air pressure in the inflatable bladder;

a manifold plate has a plurality of female receptacles open to the exterior surface; the female receptacles interconnect with the pump and the inflatable bladder;

a quick release plate has a plurality of male connectors that correspond and releasably secure to the female receptacles, each male connector has a slidable variance;

wherein when the quick release plate disengages from the manifold the inflatable bladder deflates within a predetermined time frame.

2. The patient support system of claim 1 wherein the pump is exterior to the mattress unit, and transports the pressurized air to the manifold and the inflatable bladder through the quick release plate.

3. The patient support system of claim 1 wherein the pump is within the interior chamber.

4. The patient support system of claim 1 wherein the manifold has at least three female receptacles and the quick release plate has a corresponding set of male connectors.

5. The patient support system of claim 1 wherein the inflatable bladder includes a plurality of separate zones.

6. The patient support system of claim 1 wherein the quick release plate disengages from the manifold when a pulling force is applied from an angle of 35° to 90° relative to the manifold.

7. The patient support system of claim 1 wherein the predetermined time frame is dependent upon the weight of the patient.

8. The patient support system of claim 7 wherein the predetermined time frame is under 15 seconds.

9. A process to use a patient monitoring system having a mattress unit having an interior chamber and an exterior surface;

at least one inflatable bladder is positioned in the interior chamber, the inflatable bladder has operational and collapsed states in which the inflatable bladder is respectively inflated and deflated;

a pump which controls the pressurized air pressure in the inflatable bladder;

a manifold plate has a plurality of female receptacles open to the exterior surface; the female receptacles interconnect with the pump and the inflatable bladder;

a quick release plate has a plurality of male connectors that correspond and releasably secure to the female receptacles, each male connector has a slidable variance;

wherein when the quick release plate disengages from the manifold the inflatable bladder deflates within a predetermined time frame, the process comprising the steps of:

recognizing the inflatable bladder needs to be deflated quickly; and applying a pulling force, from any angle, to the quick release plate to disengage the quick release plate from the manifold so the inflatable bladder deflates within a predetermined time frame.

10. The process of claim 9 wherein the inflatable bladder needs to be deflated quickly when the patient is in need of cardiopulmonary resuscitation.

11. The process of claim 9 wherein the pulling force is applied from an angle of 35° to 90° relative to the manifold.

12. The process of claim 9 wherein the predetermined time frame is dependent upon the weight of the patient.

13. The process of claim 8 wherein the predetermined time frame is under 15 seconds.

14. A patient support system comprising:

a mattress unit having an interior chamber and an exterior surface;

at least one inflatable bladder is positioned in the interior chamber, the inflatable bladder has operational and collapsed states in which the inflatable bladder is respectively inflated and deflated;

a pump which controls the pressurized air pressure in the inflatable bladder;

a manifold plate has a plurality of male receptacles open to the exterior surface; the male receptacles interconnect with the pump and the inflatable bladder;

a quick release plate has a plurality of female connectors that correspond and releasably secure to the male receptacles, each female connector has a slidable variance;

wherein when the quick release plate disengages from the manifold the inflatable bladder deflates within a predetermined time frame.

15. The patient support system of claim 14 wherein the pump is exterior to the mattress unit, and transports the pressurized air to the manifold and the inflatable bladder through the quick release plate.

16. The patient support system of claim 1 wherein the pump is within the the interior chamber.

17. The patient support system of claim 14 wherein the manifold has at least three male receptacles and the quick release plate has a corresponding set of female connectors.

* * * * *